US006158251A

United States Patent [19]

Sangiacomo

[11] Patent Number: 6,158,251

[45] Date of Patent: Dec. 12, 2000

[54] DEVICE FOR POSITIONING THE KNITTING CAM IN CIRCULAR KNITTING AND STOCKING KNITTING MACHINES

[75] Inventor: Fulvio Sangiacomo, Brescia, Italy

[73] Assignee: Sangiacomo S.p.A., Italy

[21] Appl. No.: 09/535,714

[22] Filed: Mar. 27, 2000

[30] Foreign Application Priority Data

May 10, 1999 [IT] Italy ..... BS990039 U

[51] Int. Cl.[7] ..... D04B 15/36

[52] U.S. Cl. ..... 66/78

[58] Field of Search ..... 66/75.1, 77, 78, 66/27, 37, 46, 57, 60 H, 64

[56] References Cited

U.S. PATENT DOCUMENTS 4,774,818 10/1988 Ploppa et al. ..... 66/78

5,284,032 2/1994 Shima ..... 66/78

FOREIGN PATENT DOCUMENTS 2251645 10/1990 Japan ..... 66/78

*Primary Examiner*—Danny Worrell

*Attorney, Agent, or Firm*—McGlew and Tuttle, P.C.

[57] ABSTRACT

A device is disclosed for positioning a knitting cam in circular knitting and stocking knitting machines. The knitting cam (11) is fixed to a slide (13), which can be moved on a support (15) by means of an eccentric ring rotated by a motor. The slide with knitting cam is provided with a first needle (18), resting on and following the eccentric inner profile of a second needle (19) resting on and following the outer surface of the eccentric ring (17) so as to move and position the slide in response to the rotation of the ring.

4 Claims, 1 Drawing Sheet

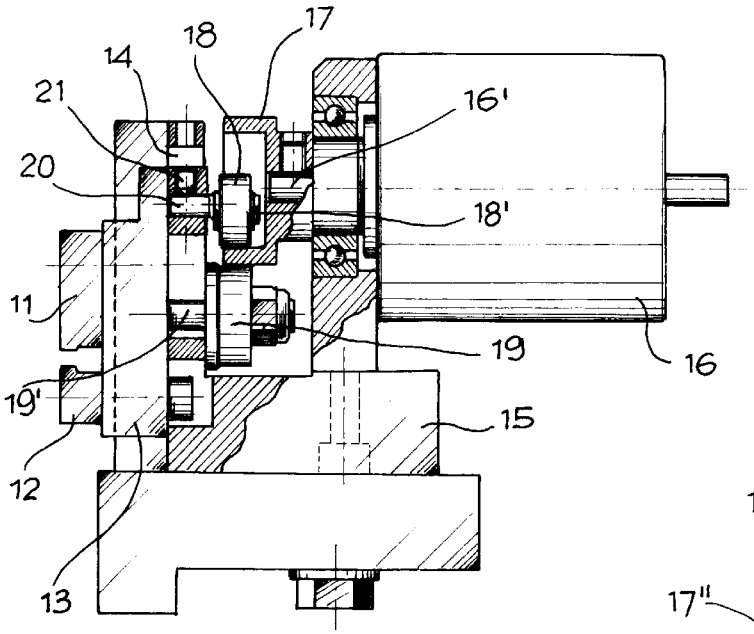
Fig. 1
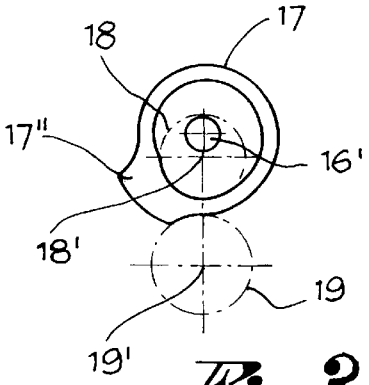
Fig. 3
Fig. 2
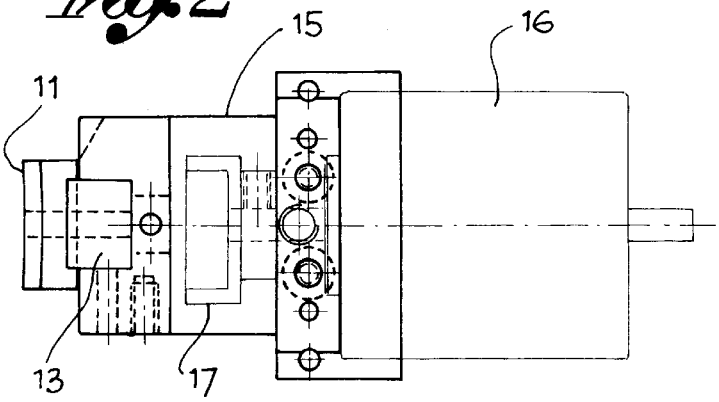
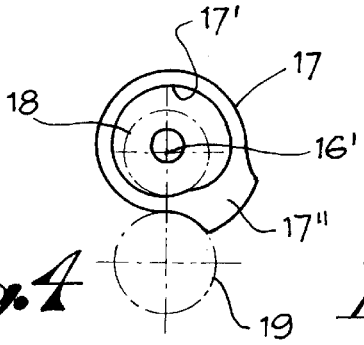
Fig. 4
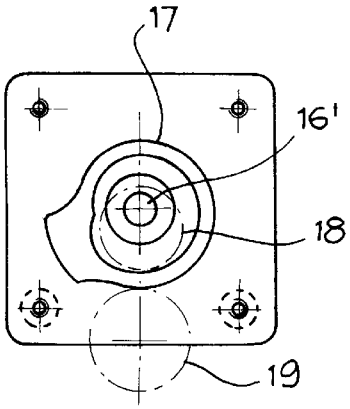
Fig. 5

DEVICE FOR POSITIONING THE KNITTING CAM IN CIRCULAR KNITTING AND STOCKING KNITTING MACHINES

FIELD OF THE INVENTION

The present invention pertains to the field of knitting and stocking knitting machines, and in particular, it pertains to a device for controlling and positioning the knitting cams in such machines.

BACKGROUND OF THE INVENTION

In circular knitting and stocking knitting machines, the knitting cam in each knitting station can be moved and positioned in height depending on the knitted article to be manufactured. In such embodiments, the knitting cam is positioned by means of an eccentric conductor which is controlled by a motor and which acts, by means of a dragging needle, on a slide which carries the knitting cam in opposition to the action of a spring, which provides that contact is maintained between eccentric conductor and conducted needle. However, the inertia of the moving parts and the response times of the spring are such that a precise and timely response in the positioning of the knitting cam to the command coming from the actuating means is not always ensured.

SUMMARY AND OBJECTS OF THE INVENTION

The primary object of the present invention is to find a solution for such a drawback of the prior art, making the control, i.e., the positioning, of a knitting cam from a cam control system more certain and reliable.

The object is accomplished by eliminating the use of an opposing spring and by maintaining a rolling contact that is positive, constant and of invariable connection between eccentric conductor and conducted needle, which are intended to move and to position a knitting cam in the machines mentioned above for manufacturing knitted articles.

According to the invention, a device for positioning a knitting cam in a circular knitting or stocking knitting machine is provided, in which the said knitting cam is fixed with a related countercam to a guiding slide that can be moved on a support. The movements of the guide for the positioning of the knitting cam are determined by a motor with an outlet shaft that carries a controlling, rotating, annular element having a slot with an eccentric or spiral-shaped inner profile and an outer surface parallel to the inner profile. The slide carries the knitting cam and has a first needle or bearing resting on and following the eccentric inner profile and a second needle or bearing that rests on follows the outer surface of the annular element on its face turned toward the controlling annular element so as to move and position the slide in response to the rotation of the annular element.

The first needle or bearing and the second needle or bearing may be mounted on parallel shafts and with adjustable distance between their centers. One of the shafts able to be moved in parallel and in relation to the other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a lateral, partial sectional view of the device according to the invention;

FIG. 2 is a plan view of the device according to the invention;

FIG. 3 is a view showing the cam control system in an extreme position;

FIG. 4 is a view showing the cam control system in another extreme position; and FIG. 5 is a view showing the cam control system in an intermediate position.

DESCRIPTION OF THE PREFERRED EMBODIMENT

Referring to the drawings in particular, a knitting cam 11 is shown with a respective countercam 12 in FIGS. 1 and 2. These two elements 11, 12 are fixed on a face of a slide 13 that is connected to and can be moved along a guiding slit 14 provided in a support 15, which is fixed on a stationary part of a circular knitting machine.

On the same support 15 is mounted a motor 16, of the stepping or another appropriate type. An outlet shaft 16' of the motor 16 is flush-fitted to an annular element 17 which has a slot with an eccentric or spiral-shaped inner profile 17' (see also FIGS. 3–5). The annular element or collar 17 faces the other face of the slide 13, opposite the one carrying the cam 11 and countercam 12.

On this other face of the slide 13 there are mounted a first needle or conducted 15 bearing 18 and a second contact needle or bearing 19, both idle, on the parallel axes 18' and 19', respectively.

The first needle or bearing 18 is arranged in the slot of the annular element 17 in order to be in contact with and follow the eccentric or spiral inner profile 17'. The second needle or bearing 19 is in contact with the outer peripheral surface of the annular element 17 and acts to maintain a certain and constant contact between the eccentric or spiral inner profile and the first needle or bearing (which is conducted).

The annular element 17, when driven by the motor 16, is able to rotate between two extreme positions, which may be defined by a projection 17" that is provided on the periphery of the annular element and intended to be supported on the second needle or bearing, the outer one 19.

The distance between the centers of the two needles or bearings 18, 19 may be regulated on the basis of the thickness of the annular element 17 and for connection without any substantial play between the needles and the annular element. For this regulation, one of the two needles, the first one, which is the upper one in FIG. 1, can be moved in relation to the other one. It may have, e.g., an eccentric pin 20, which, when rotated, makes it possible to arrange the needle 18 at a different height and which is locked in the desired position by a dowel 21.

Obviously, any other method of regulation may be used without going beyond the scope of the present invention.

In practice, with the rotation of the annular element 17 caused by the motor 16 when driven coming from a knitting program, the knitting cam is raised or lowered corresponding to the degree of rotation of this annular element 17, the slide 13 which carries the triangle being "obliged" to follow the eccentricity of the annular element 17.

While specific embodiments of the invention have been shown and described in detail to illustrate the application of the principles of the invention, it will be understood that the invention may be embodied otherwise without departing from such principles.

What is claimed is:

1. A device for positioning a knitting cam in circular knitting or stocking knitting machines, comprising:

a guiding slide;

a knitting cam;

a related countercam, said knitting cam being fixed with said related countercam to said guiding slide;

a support, said guiding slide being movable on said support; and a motor, movements of said guiding slide for a positioning of said knitting cam being determined by said motor, said motor having an outlet shaft that carries a controlling, rotating, annular element having a slot with an eccentric or spiral-shaped inner profile and an outer surface parallel to the inner profile, said guiding slide having a first needle or bearing resting on and following said eccentric inner profile and a second needle or bearing that rests on and follows said outer surface of said annular element on a face of said second needle or bearing turned toward said controlling annular element so as to move and position said slide in response to the rotation of said annular element.

2. A device in accordance with claim 1, wherein said first needle or bearing and said second needle or bearing are mounted on parallel shafts and with adjustable distance between centers, one of said shafts being able to be moved in parallel and in relation to the other.

3. A circular knitting or stocking knitting machine device for positioning a knitting cam, the device comprising:

a guiding slide;

a knitting cam;

a related countercam, said knitting cam being fixed with said related countercam to said guiding slide;

a support, said guiding slide being movable on said support;

a motor, said motor having an outlet shaft;

rotating annular element carried by said outlet shaft, said annular element having an eccentric or spiral-shaped inner profile and an outer surface following said inner profile;

a first bearing connected to said guiding slide, said first bearing resting on and following said eccentric inner profile; and a second bearing connected to said guiding slide, said second bearing having a surface turned toward said annular element and resting on and following said outer surface of said annular element so as to move and position said slide in response to the rotation of said annular element.

4. A device in accordance with claim 3, wherein said first bearing and said second bearing are mounted on parallel shafts and with adjustable distance between centers, one of said shafts being able to be moved in parallel and in relation to the other.

* * * * *